US006688534B2

(12) United States Patent
Bretz

(10) Patent No.: US 6,688,534 B2
(45) Date of Patent: Feb. 10, 2004

(54) AIR ASSIST FUEL NOZZLE

(75) Inventor: David H. Bretz, West Des Moines, IA (US)

(73) Assignee: Delavan Inc, West Des Moines, IA (US)

( * ) Notice: Subject to any disclaimer, the term of this patent is extended or adjusted under 35 U.S.C. 154(b) by 88 days.

(21) Appl. No.: 09/800,701

(22) Filed: Mar. 7, 2001

(65) Prior Publication Data

US 2002/0125336 A1 Sep. 12, 2002

(51) Int. Cl.[7] ..... A62C 5/02; B05B 7/10

(52) U.S. Cl. ..... 239/8; 239/135; 239/398; 239/403; 239/406; 239/422; 239/423

(58) Field of Search ..... 239/8, 135, 398, 239/399, 400, 403, 405, 406, 418, 422, 423, 427.5, 428, 434.5

(56) References Cited

U.S. PATENT DOCUMENTS 3,013,732 A * 12/1961 Webster et al. ..... 239/404
3,474,970 A 10/1969 Simmons et al.
3,638,865 A * 2/1972 McEneny et al. ..... 239/424
3,866,413 A 2/1975 Sturgess
4,168,803 A 9/1979 Simmons et al.
4,584,834 A * 4/1986 Koshoffer et al. ..... 60/737
5,115,634 A 5/1992 Bretz et al.
5,224,333 A 7/1993 Bretz et al.
5,373,693 A * 12/1994 Zarzalis et al. ..... 60/39.23
5,491,972 A 2/1996 Bretz et al.
5,737,921 A * 4/1998 Jones et al. ..... 60/740
5,761,907 A 6/1998 Pelletier et al.
6,272,840 B1 * 8/2001 Crocker et al. ..... 60/776
6,547,163 B1 * 4/2003 Mansour et al. ..... 239/404

OTHER PUBLICATIONS

Lefebvre, Arthur H., Gas Turbine Combustion, 2nd ed., 1999, pp. 213–215.

* cited by examiner

*Primary Examiner*—Robin O. Evans
(74) *Attorney, Agent, or Firm*—Scott D. Wofsy; Edwards & Angell, LLP

(57) ABSTRACT

A fuel injector for a gas turbine is disclosed which includes a nozzle body having a discharge portion defining a discharge orifice, the discharge portion including a fuel circuit for directing a hollow fuel film toward the discharge orifice from a fuel pump associated with the gas turbine, and an air assist circuit for directing pressurized air from a source external to the gas turbine toward the fuel film upstream from the discharge orifice to impinge on an inner surface of the fuel film issuing from the discharge orifice.

25 Claims, 4 Drawing Sheets

AIR ASSIST FUEL NOZZLE

BACKGROUND OF THE INVENTION

1. Field of the Invention

The subject invention is directed to fuel injectors for gas turbines, and more particular, to fuel nozzles for gas turbine applications which include an air assist circuit for enhancing fuel atomization during engine ignition.

2. Background of the Related Art

Gas turbines are employed in a variety of applications including electric power generation, military and commercial aviation, pipeline transmission and marine transportation. A common problem associated with gas turbines is the difficulty associated with initiating fuel ignition during engine startup cycles. Moreover, during startup, the fuel must be presented in a sufficiently atomized condition to initiate and support ignition. However, at engine startup, when the engine is gradually spooling up, the fuel and/or air pressure needed to atomize the fuel is generally unavailable.

A broad range of fuel injection devices and methods has been developed to enhance fuel atomization during engine ignition sequences. One approach has been to employ air assist atomizers which utilize high pressure, high velocity air from an external source to augment the atomization process at the low fuel injection pressures that exist during engine startup. Air assist atomizers have been constructed in such a manner so that the externally supplied high pressure, high velocity air is internally mixed with fuel within the nozzle before issuing from the discharge orifice. However, this internal mixing of the air and fuel creates an undesirable back pressure within the nozzle.

Air assist atomizer have also been constructed in such a manner so that the air assist circuit directs high pressure, high velocity air from an external source toward the fuel film so that it impinges upon an outer surface of the fuel film downstream of the discharge orifice. This avoids the back pressure associated with the internal-mixing method, as there is no internal communication between the air and fuel. It is less efficient however, than the internal-mixing concept, and higher flow rates are needed to achieve the same degree of atomization.

Another approach to enhance fuel atomization during engine ignition has been to employ airblast atomizers which function in substantially the same manner as air assist atomizers, in that both utilize the kinetic energy of a flowing air stream to shatter a fuel sheet into fine droplets. The main difference between the two atomization concepts is the quantity of air employed and its atomizing velocity. With air assist nozzles, where the air is supplied from an external or auxiliary compressor or a high-pressure cylinder, rather than from the engine compressor discharge, it is important to keep the airflow rate to a minimum. Furthermore, since there are virtually no restrictions on air pressure for air assist atomization, the air velocity can be very high. Thus, air assist atomizers are generally characterized by their use of a relatively small quantity of very high velocity air.

In contrast, because the air velocity through an airblast atomizer is limited to a maximum value corresponding to the pressure differential across the combustor liner, a larger amount of air is required to achieve good atomization. Most airblast atomizers in use today are of the prefilming type, wherein fuel is first spread out into a thin continuous sheet and then subjected to the atomizing action of a high velocity air.

It would be beneficial to provide an air assist fuel injection method that is more efficient than previously methods of air assist atomization, and which can be employed in conjunction with prefilming air blast atomizers as well as pressure atomizers.

SUMMARY OF THE INVENTION

The subject invention is directed to a new and useful air assist fuel injection method for gas turbine engine applications that is adapted to enhance fuel atomization, particularly during an engine ignition sequence, and which can be employed in conjunction with prefilming airblast atomizers as well as pressure atomizers.

More particularly, the subject invention is directed to a new and useful fuel injector that includes a nozzle body having a discharge portion that defines a discharge orifice. The discharge portion includes a fuel circuit for directing a hollow fuel film toward the discharge orifice from a fuel pump powered by the gas turbine. The discharge portion further includes an air assist circuit for directing high pressure, high velocity air toward the fuel film, upstream from the discharge orifice, from a source external to the gas turbine to impinge on an inner surface of the fuel film issuing from the discharge orifice, so as to atomize the fuel.

It is envisioned that the fuel injector of the subject invention may be employed in conjunction with a land-based engine, whereby the air assist circuit of the discharge portion is supplied by an external compressor. It is also envisioned that the fuel injector of the subject invention may be employed with a propulsion engine, such as an aircraft engine, whereby the air assist circuit of the discharge portion is supplied by an external storage tank. In such an instance, the external storage tank is preferably charged by the gas turbine during high pressure operating cycles.

In accordance with a preferred embodiment of the subject invention, the discharge portion of the fuel injector further includes a first air blast circuit for directing engine compressor discharge air toward the fuel film upstream from the discharge orifice to impinge on an inner surface of the fuel film issuing from the orifice, and a second air blast circuit for directing engine compressor discharge air toward the fuel film downstream from the discharge orifice to impinge on an outer surface of the fuel film issuing from the discharge orifice.

The nozzle body of the fuel injector further includes a fuel inlet for admitting fuel into the fuel circuit from the fuel pump, an air assist inlet for admitting air into the air assist circuit for an external source, a first air inlet for admitting air into the first air blast circuit from the engine compressor discharge, and a second air inlet for admitting air into the second air blast circuit from the engine compressor discharge.

The subject invention is also directed to a new and useful method of fuel atomization in a fuel injector of a gas turbine. The method includes the steps of providing a nozzle having a discharge portion defining a discharge orifice, directing a hollow fuel film toward the discharge orifice from a fuel pump associated with the gas turbine, and directing high pressure, high velocity air toward the fuel film upstream from the discharge orifice from a source external to the gas turbine to impinge on an inside surface of the fuel film issuing from the discharge orifice.

The method further includes the steps of directing engine compressor discharge air toward the fuel film, downstream from the discharge orifice, to impinge on an outside surface of the fuel film issuing from the discharge orifice, and directing engine compressor discharge air toward the fuel film, upstream from discharge orifice, to impinge on an inside surface of the fuel film issuing from the discharge orifice. Preferably, the step of directing air toward the fuel film from a source external to the gas turbine occurs during engine ignition.

The subject invention is also directed to an airblast atomization nozzle for a gas turbine. The airblast atomization nozzle includes an outer air cap having an interior chamber. An air swirler is disposed within the interior chamber of the air cap and it has an axial bore extending therethrough. The air cap and the air swirler define an outer airblast circuit therebetween. A prefilmer is disposed within the axial bore of the air swirler and it has an axial bore extending therethrough. A fuel swirler is disposed within the axial bore of the prefilmer and it has an axial bore extending therethrough. The prefilmer and the fuel swirler define a fuel circuit therebetween. A heat shield is disposed within the axial bore of the fuel swirler and it has an axial bore extending therethrough that defines an inner airblast circuit. The heat shield and the fuel swirler define an air assist circuit therebetween. The airblast atomization nozzle further includes a nozzle body having means for delivering fuel to the fuel circuit from a fuel pump associated with the gas turbine, and means for delivering high pressure, high velocity air to the air assist circuit from a supply source external to the gas turbine.

The subject invention is also directed to a pressure atomization nozzle for a gas turbine. The pressure atomization nozzle includes an outer cone having an axial bore extending therethrough. A fuel swirler is disposed within the axial bore of the cone and it has an axial bore extending therethrough. The cone and the fuel swirler define a fuel circuit therebetween for receiving low pressure fuel from a fuel pump associated with the gas turbine. An air swirler is disposed within the axial bore of the fuel swirler. The air swirler and the fuel swirler define an air assist circuit therebetween for receiving high pressure, high velocity air from a supply source external to the gas turbine.

These and other aspects of the subject invention and the method of using the same will become more readily apparent to those having ordinary skill in the art from the following detailed description of the invention taken in conjunction with the drawings described hereinbelow.

BRIEF DESCRIPTION OF THE DRAWINGS

So that those having ordinary skill in the art to which the subject invention pertains will more readily understand how to make and use the subject invention, preferred embodiments thereof will be described in detail hereinbelow with reference to the drawings, wherein.

DETAILED DESCRIPTION OF PREFERRED EMBODIMENTS

Figure 1:
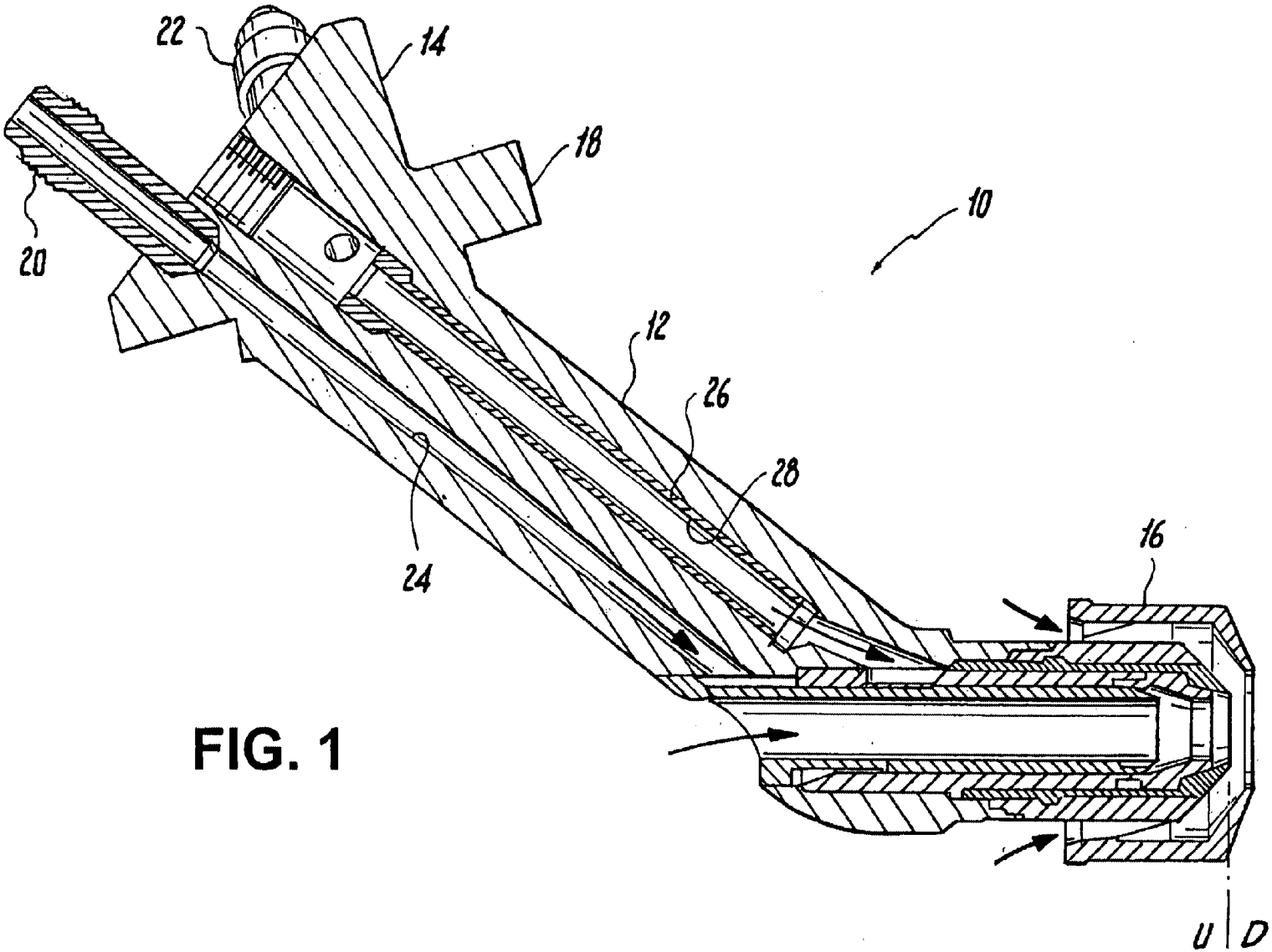
FIG. 1 is a side elevational view in cross-section of an air assist fuel nozzle assembly constructed in accordance with a preferred embodiment of the subject invention.

In the description which follows, as is common in the art to which the subject invention appertains, the term "upstream" shall refer to a location in the injector nozzle that is rearward of the discharge orifice of the nozzle, while the term "downstream" shall refer to a location in the injector nozzle that is forward of the discharge orifice of the nozzle, as identified in FIG. 1 by reference characters U and D.

Referring now to the drawings wherein like reference numerals identify similar features of the apparatus of the subject invention, there is illustrated in FIG. 1, an air assist fuel nozzle assembly constructed in accordance with a preferred embodiment of the subject invention and designated generally by reference numeral 10. Nozzle assembly 10 includes a nozzle body defined by an elongated feedarm 12 having an inlet portion 14 at the rearward end thereof and a discharge portion 16 at the forward end thereof. A mounting flange 18 is associated with the feedarm 12 for mounting the nozzle assembly to the combustor wall of a gas turbine with which the nozzle is employed.

Figure 3A:
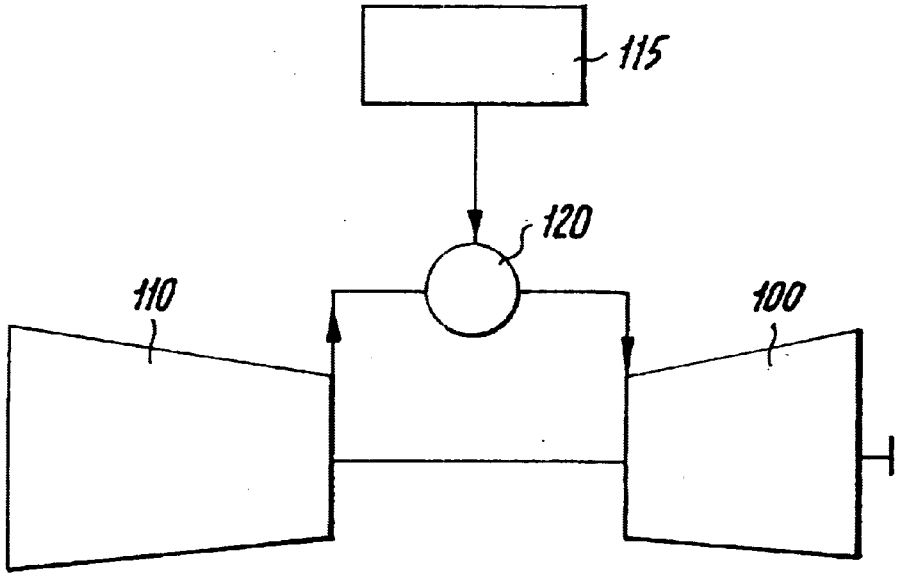
FIG. 3A is a schematic representation of a land based gas turbine engine.
Figure 3B:
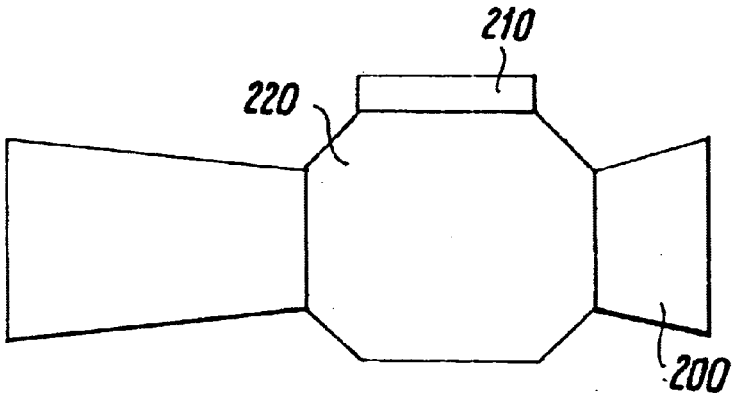
FIG. 3B is a schematic representation of a gas turbine engine used for propulsion.

The inlet portion 14 includes a threaded fitting 20 for communicating with an external air supply by way of an appropriate air conduit. When the nozzle assembly 10 of the subject invention is employed in conjunction with a land based engine, the external air supply is provided by an external compressor 115, such a shop air server. The external compressor 115 and the engine compressor 110 communicate with a turbine 100 by way of a combustion chamber 120, as depicted schematically in FIG. 3A. When the nozzle assembly 10 of the subject invention is employed with a propulsion engine, the external air supply is provided by a storage tank or cylinder 210 operatively associated with the combustor 220 of turbine 200, as depicted schematically in FIG. 3B.

The inlet portion 14 further includes a fitting 22 for communicating with a fuel pump by way an appropriate fuel conduit (not shown). Feedarm 12 defines an interior bore 24 for directing high pressure, high velocity air from the inlet portion 14 to the discharge portion 16 of nozzle assembly 10. Similarly, feedarm 12 defines an interior bore 26 which supports a fuel tube 28 that directs fuel from the inlet portion 14 to the discharge portion 16 of nozzle assembly 10.

Figure 2:
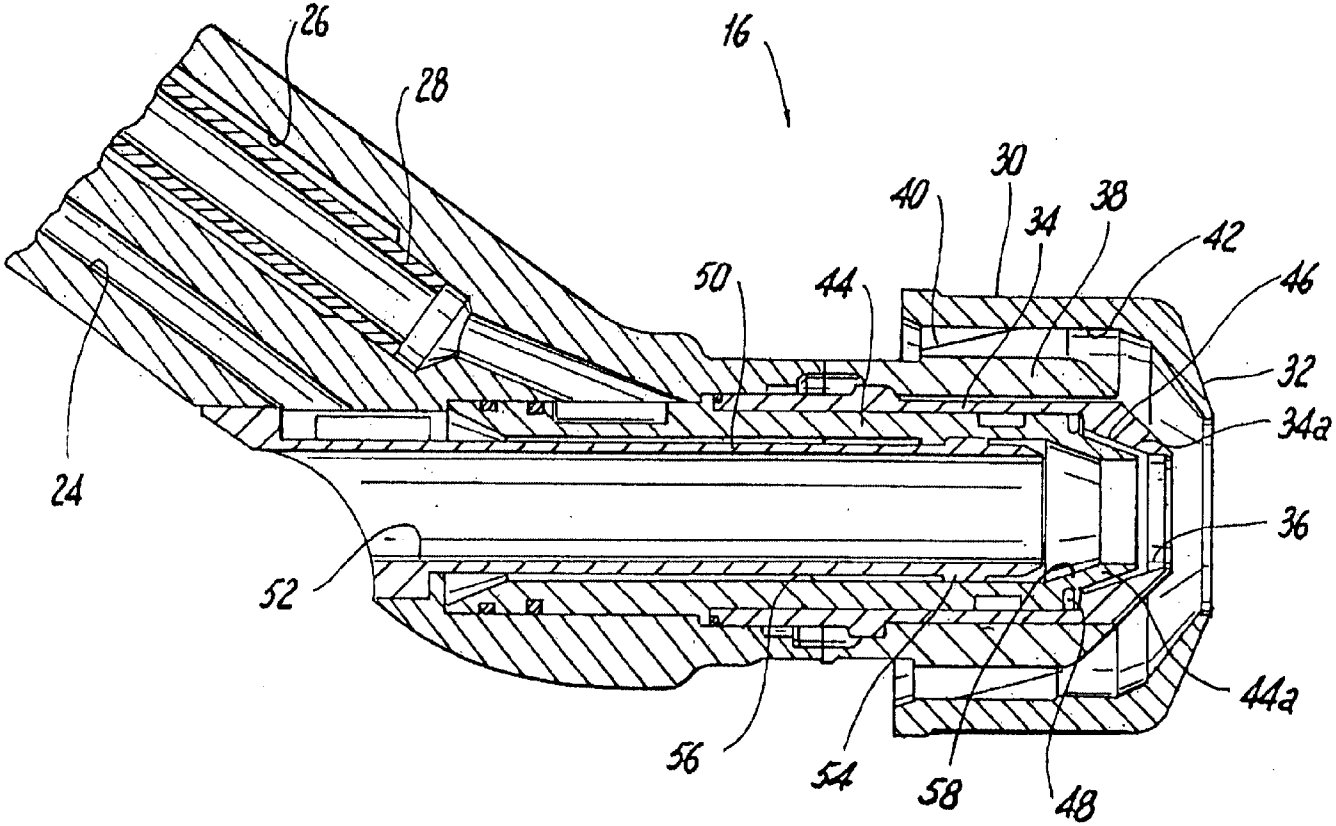
FIG. 2 is an enlarged side elevational view in cross-section of the discharge portion of the air assist fuel nozzle assembly of FIG. 1.

Referring now to FIG. 2, the discharge portion 16 of fuel nozzle 10, which is generally referred to as a prefilming air blast atomizer nozzle, includes a plurality of components, each of which are secured to the nozzle body by welding and or brazing. The plural components include an outer air cap or shroud 30 having a radially inwardly directed forward deflector portion 32. Disposed within the air cap 30 is a prefilmer 34 that has an axial bore extending therethrough and a tapered end portion 34*a* which defines the discharge orifice 36 of the nozzle assembly.

An outer air swirler 38 surrounds the prefilmer 34, and includes plurality of circumferentially disposed vanes 40. The air swirler 38, together with the interior of air cap 30, defines an outer air blast circuit 42 for directing engine compressor discharge air toward the discharge orifice 36 to impinge upon an outer surface of the fuel film issuing therefrom. The vanes 40 of outer swirler 38 impart a swirling motion to the air flowing through the outer airblast circuit 42, and the forward deflector portion 32 of air cap 30 directs the swirling engine compressor discharge air toward the fuel film downstream from discharge orifice 36 to facilitate atomization of the fuel film.

A fuel swirler 44 having an axial bore and a tapered nose portion 44*a* is disposed within the axial bore of the prefilmer 34. A fuel circuit 46 is formed between the fuel swirler 44 and the prefilmer 34 for directing fuel toward the discharge orifice 36 of prefilmer 34. The fuel circuit 46 is adapted and configured to issue a swirling hollow film or sheet of fuel having a generally conical shape from the discharge orifice 36 of the prefilmer 34. Fuel circuit 46 is preferably defined by a bifurcated channel (not shown), both sections of which feed a plurality of angled fuel slots which lead to a swirl chamber 48 and impart a swirling motion to the fuel film. Fuel circuit 46 is feed by the fuel tube 28 that extends through feedarm 12 between inlet portion 14 and discharge portion 16.

A cylindrical heat shield 50 is disposed within the upstream section of the axial bore of fuel swirler 44. Heat shield 50 defines an inner air blast circuit 52 for directing engine compressor discharge air toward the fuel film, upstream from the discharge orifice 36, to impinge upon an inner surface of a fuel film issuing therefrom. During engine operation, heat shield 50 prevents hot compressor air, which can reach a temperature as high as 1600° F., from reacting with the fuel flowing through fuel circuit 46. An annular ring 54 surrounds the forward end portion of heat shield 50 to create a clearance gap between the heat shield 50 and the axial bore of fuel swirler 44.

With continuing reference to FIG. 2, an air assist circuit 56 is defined by the clearance gap between the outer surface of heat shield 50 and the interior bore of fuel swirler 44 for directing high pressure, high velocity air toward the fuel film, upstream from the discharge orifice 36, so as to impinge upon the inner surface of the fuel film issuing therefrom. Air assist circuit 56 includes a plurality of circumferentially spaced apart angled slots formed in the annular ring 54 for imparting a swirling motion to the air assist current. The air assist circuit 56 communicates with the interior bore 24 of feedarm 12 which receives pressurized air from an external supply source through inlet portion 14. During an engine ignition sequence, the swirling air from the air assist circuit 56 and the engine compressor discharge air entering the nozzle through the inner air blast circuit 52 merge within the mixing chamber 58 of fuel swirler 44, prior to impinging upon the inner surface of the fuel film issuing from discharge orifice 36.

In operation, to commence engine startup, the turbine is cranked at a low rpm by a battery powered starter motor or the like. At the same time, the fuel pump and compressor associated with the turbine are also cranked at a low rpm. At these low cranking speeds, a small volume of fuel is delivered to the inlet portion 14 of nozzle assembly 10 by the engine fuel pump on the order of 5 psig or less. This is significantly less than the fuel pressure developed during operation of the turbine. Also, during this initial startup period, a high volume of low pressure air is produced by the engine compressor. This low pressure air is directed toward the discharge portion 16 of nozzle assembly 10 within the combustor, as depicted in FIG. 1 by a series of directional flow arrows. In general, the combination of the low pressure, high volume air and the low pressure fuel flow would make fuel atomization at startup relatively difficult. In the nozzle assembly of subject invention, the air assist circuit 56 enhances and promotes fuel atomization under these startup conditions.

More particularly, in accordance with the subject invention, during the engine startup sequence, high pressure, high velocity air is delivered to the inlet portion 14 of nozzle assembly 10 from an external supply source. (See FIGS. 3A and 3B). This may be accomplished by actuating a valve or similar control device operatively associated with the external supply source. The high pressure, high velocity air flow from the external supply source is delivered to the air assist circuit 56 defined by the fuel swirler 44 wherein a swirling motion is imparted to the air flow.

The swirling air assist current then merges with the low pressure compressor discharge air current traveling through the inner air blast circuit 52, and is then directed at the swirling fuel film issuing from the discharge orifice 36 of prefilmer 34, so as to impinge upon an inner surface of the fuel film. At the same time, a swirling current of low pressure compressor discharge air is directed through the outer air blast circuit 42 toward an outer surface of the swirling fuel film issuing from the discharge orifice 36. These combined airflows, acting on the inner and outer surfaces of the relatively low pressure fuel film serve to atomize the fuel for engine ignition.

Once ignition occurs, the turbine will come up to its normal operating speed, at which time the fuel pressure supplied by the pump and the air pressure supplied by the engine compressor will increase to normal operating levels. By this time, the external air supply will have been expended or the flow therefrom will have been deactivated. It is envisioned that an external air supply spent during startup can be charged by a compressor during normal high pressure engine operation.

Figure 4:
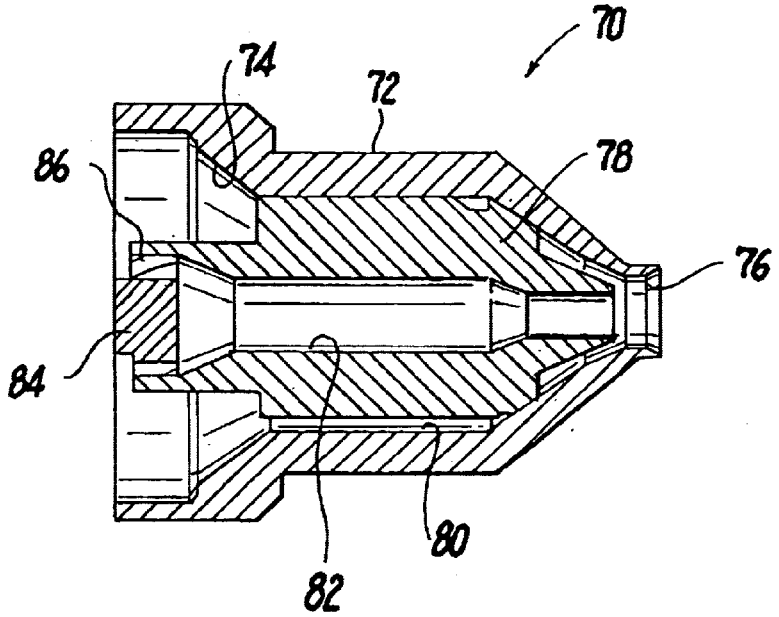
FIG. 4 is a side elevational view in cross-section of an air assist pressure atomizer constructed in accordance with a preferred embodiment of the subject invention.

Referring now to FIG. 4, there is illustrated an air assist pressure atomization nozzle constructed in accordance with a preferred embodiment of the subject invention and designated generally by reference numeral 70. Pressure atomization nozzles are commonly employed with small auxiliary power units. In general, in order to operate at low fuel flow rates associated with ignition, the fuel circuit of a pressure atomization nozzle is provided with a plurality of relatively small fluid passages designed to produce the high fuel velocities required for atomization. These small passages are susceptible to fuel contamination and carbon formation, thus limiting the service life of the nozzle.

The air assist pressure atomization nozzle 70 of the subject invention overcomes the problems associated with prior art pressure atomization nozzles by providing a fuel circuit with relatively large fuel passages that are unlikely to be susceptible to fuel contamination or carbon formation, and an air assist circuit for directing high pressure, high velocity air toward an inner surface of a hollow fuel film to atomize the fuel during ignition. More particularly, as illustrated in FIG. 4, pressure atomizer 70 includes an outer cone 72 defining an interior cavity 74 and a discharge orifice 76. A fuel swirler 78 is supported within the cavity 74 of outer cone 72, and a fuel circuit 80 is defined between the wall of cavity 74 and fuel swirler 78. Fuel circuit 80 is defined by a channel formed in the outer surface of fuel swirler 78 which includes a plurality of circumferentially spaced apart spin slots (not shown) that impart a spinning motion to the fuel as it issues from the discharge orifice 76 of the outer cone 72.

Fuel swirler 78 has an axial bore extending therethrough which defines an air assist circuit 82 for directing high pressure, high velocity air from an external supply source toward the inner surface of the swirling fuel film issuing from discharge orifice 76. An air swirler 84 is disposed at the rearward end of air assist circuit 82. Air swirler 84 includes a plurality of circumferentially disposed vanes 86 for imparting a spinning motion to the air assist current. Those skilled in the art will readily appreciate that pressure atomizer 70 is operatively associated with a nozzle body, not unlike that which is illustrated in FIG. 1. In operation, during ignition, the swirling air assist current is directed through the air assist circuit 82, so as to impinge upon the inner surface of the fuel film issuing from discharge orifice 76, so as to effectuate atomization of the low pressure fuel.

Figure 5:
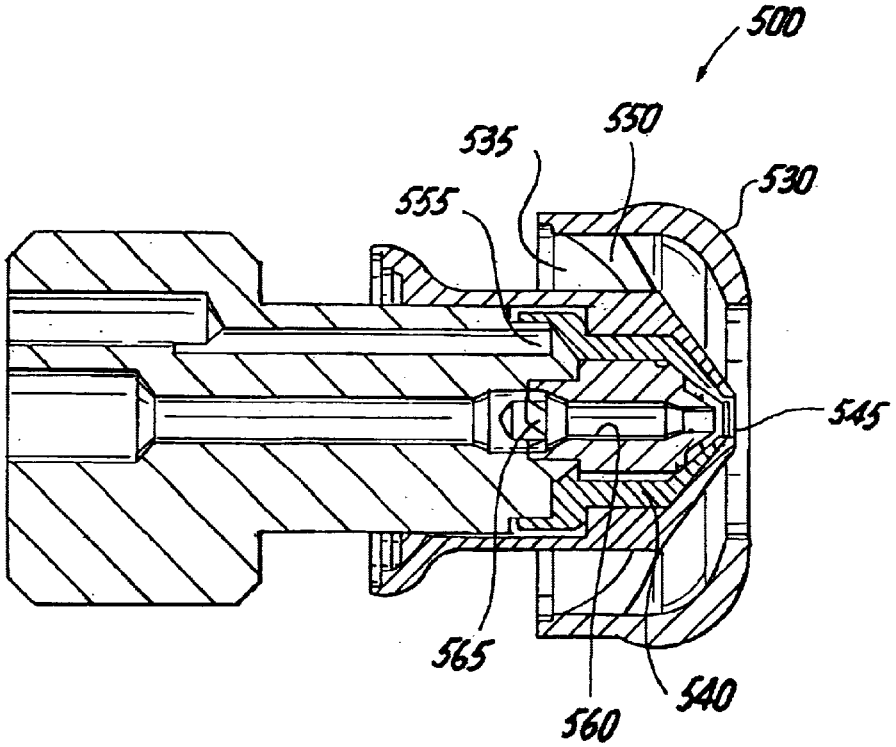
FIG. 5 is a side elevational view in cross-section of a simplex airblast nozzle having an air assist circuit constructed in accordance with a preferred embodiment of the subject invention.

Referring now to FIG. 5, there is illustrated a simplex airblast nozzle constructed in a accordance with a preferred embodiment of the subject invention and designated generally by reference numeral 500. Simplex airblast nozzle 500 includes an outer air cap 530 that surrounds an internal pressure atomizer 540. An air blast circuit 535 is defined between air cap 530 and pressure atomizer 540 for directing compressor discharge air toward the outer surface of a fuel film issuing from the discharge orifice 545 of the nozzle. Swirl vanes 550 are associated with air blast circuit 535 for imparting a swirling motion to the air flowing therethrough.

Pressure atomizer 540 further includes a fuel circuit 555 for receiving fuel from a fuel pump and for directing the fuel to the nozzle orifice 545 in the form of a film. Fuel circuit 555 preferably includes structure for imparting a spinning motion to the fuel flowing therethrough. An air assist circuit 560 extends axially through the pressure atomizer 540 for conducting high pressure, high velocity air from an external supply source toward an inner surface of the fuel film issuing from the discharge orifice 545 of the nozzle. An air swirler 565 is disposed at the rearward end of air assist circuit 560 for imparting a spinning motion to the air assist current flowing therethrough.

In accordance with a preferred embodiment of the subject invention, it is envisioned that the air assist circuit of the subject invention can also be employed with a simplex airblast fuel atomization nozzle such as that which is disclosed in commonly assigned U.S. Pat. No. 5,224,333 to Bretz et al., the disclosure of which is incorporated by reference herein in its entirety. In the simplex airblast nozzle of U.S. Pat. No. 5,224,333, two airblast circuits direct compressor discharge air toward the outer surface of the fuel film issuing from the discharge orifice of the nozzle, with the nozzle orifice receiving fuel from an internal pressure atomizer. The air assist circuit defined within this simplex airblast nozzle would extend through the center of the nozzle to direct high pressure, high velocity air toward the inner surface of the fuel film issuing from the discharge orifice of the nozzle.

Although the subject invention has been described with respect to preferred embodiments, those skilled in the art will readily appreciate that changes and modifications may be made thereto without departing from the spirit and scope of the present invention as defined by the appended claims.

What is claimed is:

1. A fuel injector for a gas turbine comprising:

a nozzle body having a discharge portion defining a discharge orifice, the discharge portion including a fuel circuit for directing a hollow fuel film toward the discharge orifice from a fuel pump associated with the gas turbine, an air blast circuit for directing engine compressor discharge air toward the fuel film, and an air assist circuit formed within the discharge portion of the nozzle body for directing pressurized air from a source external to the gas turbine toward the fuel film upstream from the discharge orifice to merge with engine compressor discharge air from the air blast circuit and impinge on an inner surface of the fuel film issuing from the discharge orifice.

2. A fuel injector as recited in claim 1, wherein the air assist circuit of the discharge portion is in communication with an external compressor associated with the gas turbine.

3. A fuel injector as recited in claim 1, wherein the air assist circuit of the discharge portion is in communication with an external storage tank associated with the gas turbine.

4. A fuel injector as recited in claim 3, wherein the external storage tank is charged by the gas turbine during high pressure operating cycles.

5. A fuel injector as recited in claim 1, wherein the discharge portion includes a first air blast circuit for directing engine compressor discharge air toward the fuel film upstream from the discharge orifice to impinge on the inner surface of the fuel film issuing from the discharge orifice, and a second air blast circuit for directing engine compressor discharge air toward the fuel film downstream from the discharge orifice to impinge on an outer surface of the fuel film issuing from the discharge orifice.

6. A fuel injector as recited in claim 1, wherein the nozzle body includes a fuel inlet for admitting fuel into the fuel circuit.

7. A fuel injector as recited in claim 1, wherein the nozzle body includes an air assist inlet for admitting pressurized air into the air assist circuit.

8. A fuel injector as recited in claim 5, wherein the nozzle body includes a first air inlet for admitting engine compressor discharge air into the first air blast circuit and a second air inlet for admitting engine compressor discharge air into the second air blast circuit.

9. A fuel injector as recited in claim 1, wherein the nozzle body is configured as at least one of an airblast atomizer and a simplex airblast atomizer.

10. A fuel injector as recited in claim 1, wherein the nozzle body is configured as a pressure atomizer.

11. A fuel injector as recited in claim 1, wherein engine compressor discharge air from the air blast circuit and pressurized air from the air assist circuit merge within a mixing chamber upstream from the discharge orifice.

12. A fuel injector for a gas turbine comprising:

a) an inlet portion including a fuel inlet for receiving fuel from a fuel pump associated with the gas turbine, and an air assist inlet for receiving pressurized air from a source external to the gas turbine; and b) a discharge portion defining a discharge orifice, the discharge orifice including a fuel circuit for directing a hollow fuel film toward the discharge orifice from the fuel inlet, an air blast circuit for directing engine compressor discharge air toward the fuel film, and an air assist circuit formed within the discharge portion for directing pressurized air from the air assist inlet toward the fuel film upstream from the discharge orifice to merge with engine compressor discharge air from the air blast circuit and impinge on an inner surface of the fuel film issuing from the discharge orifice.

13. A fuel injector as recited in claim 12, wherein the air assist circuit of the discharge potion is in communication with an external storage tank associated with the gas turbine.

14. A fuel injector as recited in claim 13, wherein the external storage tank is charged by the gas turbine during high pressure operating cycles.

15. A fuel injector as recited in claim 12, wherein the discharge portion includes a first air blast circuit for directing engine compressor discharge air toward the fuel film upstream from the discharge orifice to impinge on the inner surface of the fuel film issuing from the discharge orifice, and a second air blast circuit for directing engine compressor discharge air toward the fuel film downstream from the discharge orifice to impinge on an outer surface of the fuel film issuing from the discharge orifice.

16. A fuel injector as recited in claim 15, further comprising a nozzle body extending between the inlet portion and the discharge portion, wherein the nozzle body includes a first air inlet for admitting engine compressor discharge air into the first air blast circuit and the discharge portion includes a second air inlet for admitting engine compressor discharge air into the second air blast circuit.

17. A fuel injector as recited in claim 12, wherein the air assist circuit of the discharge potion is in communication with an external compressor associated with the gas turbine.

18. A fuel injector as recited in claim 12, wherein engine compressor discharge air from the air blast circuit and pressurized air from the air assist circuit merge within a mixing chamber upstream from the discharge orifice.

19. A method of fuel atomization in a fuel injector for a gas turbine comprising the steps of:

a) providing a nozzle having a discharge portion defining a discharge orifice;

b) directing a hollow fuel film toward the discharge orifice from a fuel pump associated with the gas turbine;

c) directing engine compressor discharge air through an airblast circuit formed in the discharge portion of the nozzle toward the fuel film; and d) directing pressurized air through an air assist circuit formed in the discharge portion of the nozzle toward the fuel film upstream from the discharge orifice from a source external to the gas turbine to merge with the engine compressor discharge air and impinge on an inside surface of the fuel film issuing from the discharge orifice.

20. A method of fuel atomization according to claim 19, wherein the step of directing pressurized air toward the discharge orifice from a source external to the gas turbine occurs during engine ignition.

21. A method of fuel atomization according to claim 19, wherein the step of directing engine compressor discharge air toward the fuel film includes directing engine compressor discharge air toward the fuel film downstream from the discharge orifice to impinge on an outside surface of the fuel film issuing from the discharge orifice.

22. A method of fuel atomization according to claim 19, wherein the step of directing engine compressor discharge air toward the fuel film includes directing engine compressor discharge air toward the fuel film upstream from the discharge orifice to impinge on an inside surface of the fuel film issuing from the discharge orifice.

23. A method of fuel atomization according to claim 19, further comprising the step of merging engine compressor discharge air with pressurized air within a mixing chamber upstream from the discharge orifice.

24. A fuel injector for a gas turbine comprising:

a nozzle body having a discharge portion defining a discharge orifice, the discharge portion including a fuel circuit for directing a hollow fuel film toward the discharge orifice from a fuel pump associated with the gas turbine, and an air assist circuit for directing pressurized air from a storage tank external to the gas turbine toward the fuel film upstream from the discharge orifice to impinge on an inner surface of the fuel film issuing from the discharge orifice, wherein the external storage tank is charged by the gas turbine during high pressure operating cycles.

25. A fuel injector for a gas turbine comprising:

a) an inlet portion including a fuel inlet for receiving fuel from a fuel pump associated with the gas turbine, and an air assist inlet for receiving pressurized air from an external storage tank charged by the gas turbine during high pressure operating cycles; and b) a discharge portion defining a discharge orifice, the discharge orifice including a fuel circuit for directing a hollow fuel film toward the discharge orifice from the fuel inlet, and an air assist circuit for directing pressurized air from the air assist inlet toward the fuel film upstream from the discharge orifice to impinge on an inner surface of the fuel film issuing from the discharge orifice.

* * * * *